United States Patent [19]

Miller

[11] Patent Number: 4,836,157

[45] Date of Patent: Jun. 6, 1989

[54] COLD-START ENGINE PRIMING AND AIR PURGING SYSTEM

[75] Inventor: James K. Miller, Cass City, Mich.

[73] Assignee: Walbro Corporation, Cass City, Mich.

[21] Appl. No.: 217,462

[22] Filed: Jul. 11, 1988

Related U.S. Application Data

[63] Continuation-in-part of Ser. No. 118,629, Nov. 9, 1987.

[51] Int. Cl.[4] ..... F02M 1/16

[52] U.S. Cl. ..... 123/187.5 R; 123/180 E; 123/180 P

[58] Field of Search ..... 123/187.5 R, 179 G, 123/179 L, 180 E, 180 T, 180 P

[56] References Cited

U.S. PATENT DOCUMENTS 4,498,434 2/1985 Baltz et al. ..... 123/187.5 R

*Primary Examiner*—Andrew M. Dolinar

*Attorney, Agent, or Firm*—Barnes, Kisselle, Raisch, Choate, Whittemore & Hulbert

[57] ABSTRACT

A fuel delivery system for purging air from the reservoir of a diaphragm carburetor on an internal combustion engine and for supplying priming fuel to the carburetor air intake. An manual pump has an inlet coupled by a fuel line through the carburetor reservoir to a fuel supply, and an outlet connected by the fuel line to a constant flow rate nozzle orifice positioned at the carburetor air intake. A pressure switch is connected in the fuel line between the pump and orifice and provides a signal, in the form of a switch closure, to priming control circuitry whenever fuel, as distinguished from air, is pumped through the orifice to the carburetor air intake. The control circuitry receives battery power through the pressure switch contacts, and includes an integrator for accumulating total time of fuel flow and thereby indirectly indicating the total quantity of priming fuel supplied through the constant-flow orifice. When the integrated time duration exceeds a selected threshold, an LED is driven by an oscillator to advise the operator to terminate the manual priming operation. Most preferably, the time-duration threshold is varied as a function of engine temperature.

19 Claims, 2 Drawing Sheets

COLD-START ENGINE PRIMING AND AIR PURGING SYSTEM

This application is a continuation-in-part of application Ser. No. 118,629 filed Nov. 9, 1987.

The present convention is directed to fuel delivery systems for internal combustion engines, and more particularly to a system for priming and purging air from an engine fuel delivery system to facilitate cold-starting thereof.

BACKGROUND AND OBJECTS OF THE INVENTION

Cold-starting of internal combustion engines, particularly small engines in chain saws, snow blowers and the like, has been and remains a problem in the art. Devices such as chain saws which are frequently employed under adversed starting conditions typically embody a manual priming system, as illustrated in U.S. Pat. No. 4,271,093 (June 2, 1981), in which a resilient cap or bulb is mounted on or adjacent to the engine carburetor and may be manually activated by an operator for drawing fuel into the carburetor and purging air therefrom. Excessive activation of the cap or bulb when the engine is cold typically results in ejection of fuel into the surrounding environment. Moreover, activation of the priming system when the engine is warm, or where the engine fails to start on the first attempt, can so flood the engine carburetor that the engine will not start at all.

Parent U.S. application Ser. No. 118,629, filed Nov. 9, 1987 and assigned to the assignee hereof, discloses a fuel delivery system for purging air from the reservoir of a diaphragm carburetor on an internal combustion engine and for supplying priming fuel to the carburetor air intake. A pump is responsive to electrical signals from a priming control circuit to the draw fuel through the carburetor reservoir and to feed fuel under pressure to a nozzle positioned at the carburetor air intake. The electronic control circuitry is responsive to an operator for initiating a priming operation and includes a temperature sensor coupled to the engine for a controlling a first timer which determines time duration of the priming operation, and thus the quantity of engine priming fuel, as a function of engine temperature. A second timer is responsive to operator initiation of a priming operation for preventing regeneration of the priming control signal to the pump, and thereby preventing attempted repriming in the event of failure of the engine to start.

Although the automatic priming systems so disclosed in the parent application overcome deficiencies in the prior art noted in the preceding paragraph, a problem remains in that such automatic systems are fairly expensive to implement on small, relatively inexpensive engine-driven devices. There thus remains a need in the art for a purging and priming system of a described character which is directly responsive to quantity of fuel actually injected during a priming operation, which indicates to an engine operator that a purging and priming operation has been completed, which will retain such indication for an extended time duration so as to advise an operator that the priming operation should not be repeated, and which is less expensive to the manufacture and implement than are devices of the described character heretofore proposed. It is a general object of the present invention to provide a system which addresses such need.

More specifically, it is an object of the present invention to provide a purging and priming system of the described character which will facilitate one-pull starting of an engine over an extended temperature range, which is so constructed as to discourage misuse by an inexperienced operator, including particularly overpriming of the engine, which is powered by replaceable batteries, which is reliable over an extended operating lifetime, and which requires minimum adaptation to particular engine designs and requirements.

SUMMARY OF THE INVENTION

An engine priming and air-purging system in accordance with a preferred embodiment of the present invention includes a diaphragm-type carburetor having an internal fuel reservoir as illustrated in above-identified U.S. Pat. No. 4,271,093, and a manual pump having an inlet coupled by a fuel line through the carburetor reservoir to a fuel supply or tank. The pump output is coupled by the fuel line to a nozzle orifice at the air intake of the carburetor. Upon activation, the pump thus draws fuel from the supply through the carburetor reservoir and ejects the fuel through the nozzle into the carburetor air intake, while at the same time purging air from the carburetor reservoir and fuel line and ejecting such air into the carburetor intake. The nozzle orifice at the carburetor air intake is such that fuel is supplied therethrough at constant flow rate under pressure from the fuel pump.

Engine priming control embodies a pressure switch positioned in the fuel line and responsive to pressure of fluids therein for differentiating between ejection of fuel and ejection of air at the air intake through the nozzle orifice. In the presently preferred embodiment of the invention, the pressure switch comprises a diaphragm switch positioned between the pump outlet and the nozzle and responsive to back-pressure of fuel in the fuel line when liquid fuel is ejected at the nozzle orifice for closing a pair of switch contacts. On the other hand, when air purged from the carburetor reservoir and fuel line is ejected at the nozzle orifice, back pressure in the fuel line is such that the pressure switch contacts remain open. An electronic timer, comprising an integration capacitor and a constant current source, is responsive to closure of the pressure switch for accumulating time durations during which liquid fuel is ejected from the nozzle orifice. Since fuel flows through the orifice at a constant rate, such accumulated time duration provides a direct indication of quantity of priming fuel ejected into the carburetor air intake. When such quantity-indicating time duration reaches a selected threshold, an indication is provided to the operator so that the operator may terminate manual priming at the pump and thereby not overprime the engine.

The fuel quantity-indicating threshold may be preset and fixed at the time of manufacture. However, in the preferred embodiment of the invention, a temperature sensor is coupled to the engine and is responsive to temperature thereof for varying the time duration threshold, and thereby varying quantity of fuel ejected during the priming operation, as function of engine temperature. Furthermore, in the preferred embodiment of the invention, the integration capacitor is connected to discharge relatively slowly, over an extended time duration on the order of several minutes or more. In this way, an operator is advised not to attempt immediate repriming of the engine. The priming indicator in accordance with the presently preferred embodiment of the invention comprises an LED driven by an oscillator responsive to the timing threshold detector. The oscillator drives the LED at a low frequency visible to the human eye, preferably less than thirty hertz. Such intermittent rather than continuous illumination at the LED not only saves electrical power, but is also more readily visible in bright light.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
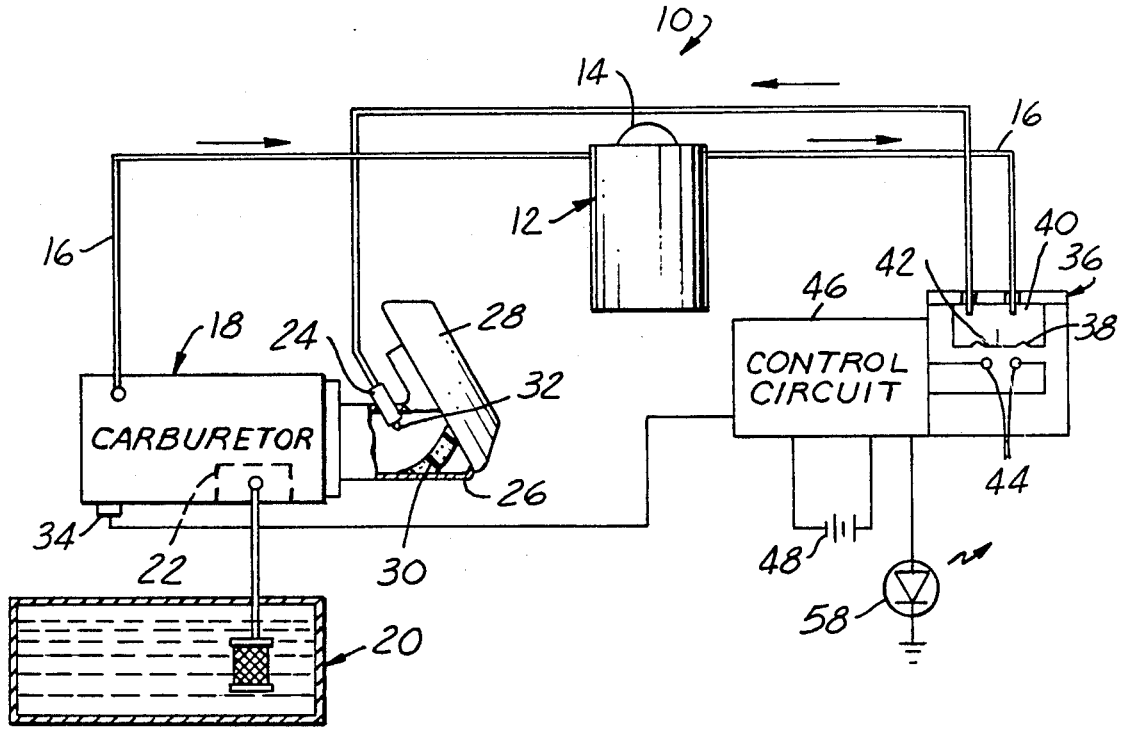
FIG. 1 is schematic diagram of a fuel priming system in accordance with a presently preferred embodiment of the invention.

FIG. 1 illustrates a fuel priming system in accordance with a presently preferred embodiment of the invention as comprising a manual bellows-type suction pump 12 having a resilient dome or bulb 14. The inlet of pump 12 is connected by a fuel line 16 through a carburetor 18 to a fuel supply 20. Carburetor 18 is preferably of the diaphragm type and includes an internal metering chamber or reservoir 22 from which fuel is normally pumped under control of pressure pulses from the engine crankcase. Such carburetor per se is of conventional construction, and an exemplary diaphragm-type carburetor of the described character is illustrated in U.S. Pat. No. 4,271,093. The output of pump 12 is connected by fuel line 16 to the nozzle 24 positioned at the air intake 26 of carburetor 18 between the carburetor and the air filter 28. A contoured block 30 of foam or other suitable construction is positioned within intake 26 across from and in opposition to the outlet orifice 32 of nozzle 24 for receiving and absorbing fuel droplets sprayed therefrom, and reevaporating fuel into air passing thereby into carburetor 18. A temperature sensor 34 is positioned on the engine at any suitable location so as to be responsive to temperature thereof.

A pressure switch 36 is connected in fuel line 16 between nozzle 24 and the outlet of pump 12 so as to be responsive to back pressure of fuel passing through fuel line 16 between pump 12 and nozzle 24. Specifically, pressure switch 36 in the preferred embodiment of the invention comprises a flexible resilient diaphragm 38 which is responsive to pressure within a fuel chamber 40 for bringing the movable contact 42 into the bridging engagement between a pair of fixed electrical contacts 44 when a fuel line pressure exceeds the threshold spring force of the switch diaphragm. Switch 36 and temperature sensor 34 are connected to a priming control circuit 46, as is the battery 48 for supplying electrical power thereto.

Figure 2:
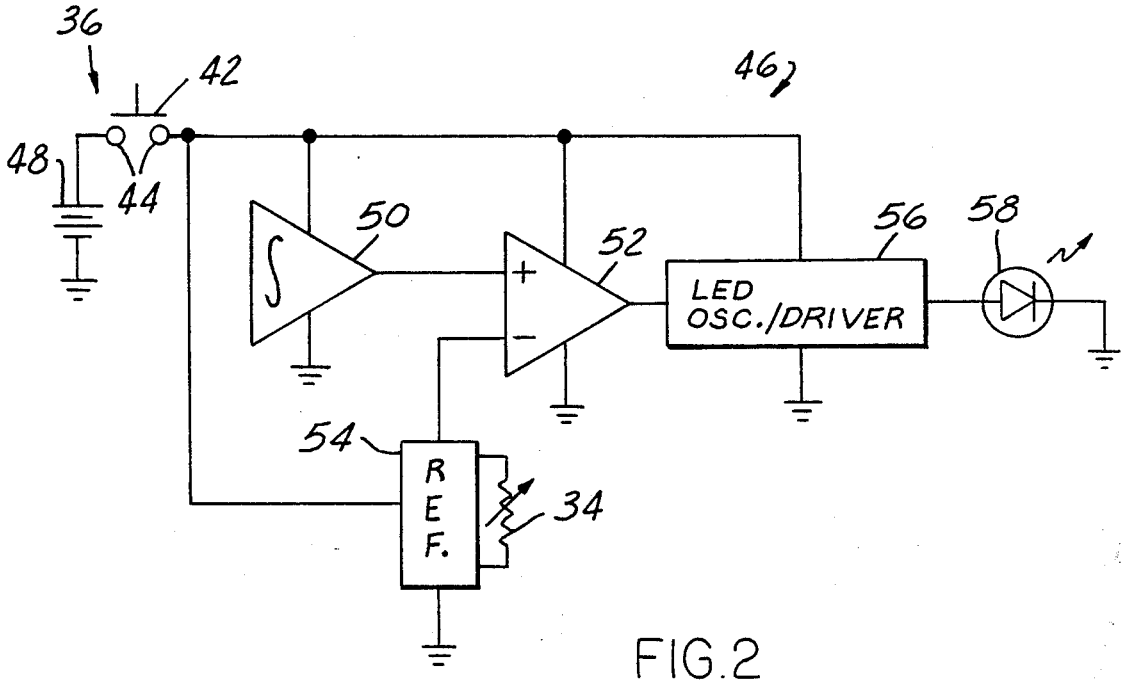
FIG. 2 is a functional block diagram of the priming control electronics in FIG. 1.
Figure 3:
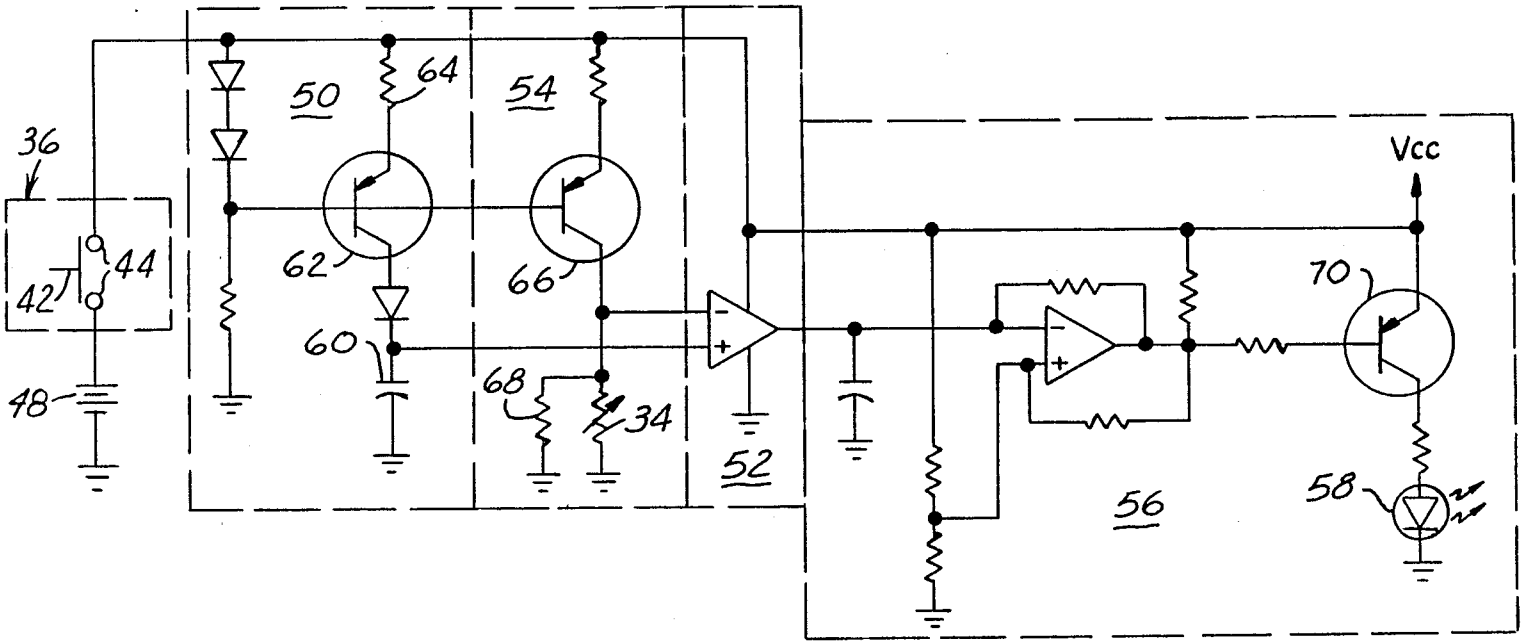
FIG. 3 is an electrical schematic diagram of the priming control electronics in the embodiment of FIGS. 1 and 2.

As shown in FIG. 2, control circuit 46 comprises an electronic timer in the form of an integrator 50 having an output connected to the non-inverting input of a comparator 52. The inverting input of comparator 52 is connected to a reference circuit 54 which includes temperature sensor 34 in the form of a temperature-responsive variable resistor. The output of comparator 52 drives an oscillator 56, which in turn drives an LED 58 (FIGS. 1–3) for advising an operator that a priming operation has been completed. The entirety of control circuit 46 receives power from battery 48 through pressure switch contacts 42, 44. As shown in FIG. 3, integrator 50 comprises a capacitor 60 driven by a constant current source 62 at a set rate, determined by the resistor 64, when pressure switch 36 is closed. Integrator 50 thus accumulates or sums the length of time during which fuel, rather than air, flows through fuel lines 16, and thus indicates total fuel delivered to the carburetor air intake. Capacitor 60 discharges through comparator 52 relatively slowly, over an extended time duration on the order of several minutes. Reference circuit 54 includes a current source 66 driving temperature-sensitive resistor 34 in parallel with a fixed resistor 68 at the reference input of comparator 52.

As previously indicated, the slope rate of integrator 50 is determined by resistor 64. This slope rate is determined empirically from the minimum and maximum amounts of fuels needed over the expected temperature range, the fuel flow rate through nozzle orifice 32 (FIG. 1) and the range of linearity of the integrator. In one working embodiment of the invention, fuel flow rate through orifice 32 was determined to be 0.637 cc/sec. Maximum and minimum total priming fuel over the expected (specified) temperature operating range were 2.5 cc at −5° F. and 0.25 cc at 82° F. Thus, maximum integration time at −5° F. is 3.92 sec (2.5 cc/0.637 cc/sec.), and minimum integration time at 82° F. is 0.392 sec (0.25 cc/0.637 cc/sec). If maximum integration time exceeds the integrator's maximum region of linearity, the integrator slope rate must be modified or the flow rate changed through use of a different orifice.

Oscillator 56 (FIGS. 2 and 3) is triggered by comparator 52 and drives LED 58 through a buffer 70 (FIG. 3) at a frequency or rate visible to the human eye. Most preferably, the frequency of oscillator 56 is less than thirty hertz. Such flashing operation of LED 58 not only saves battery power, but is also more visible in bright light than is constant illumination at LED 58.

It will thus be appreciated that the presently preferred embodiment of the invention, hereinabove described in detail, fully satisfies all of the objects and aims previously set forth. However, modifications and variations are contemplated without departing from the scope of the invention in its broadest aspects. For example, temperature sensor 34 may be eliminated, and accumulated priming duration time may be compared to a fixed threshold in some less stringent applications of the invention. Although manual pump 12 is preferred for reasons of economy, the pump could be electronically controlled from circuit 46 responsive to fuel line pressure and total priming fuel flow. Likewise, pressure switches other than diaphragm switches 36 may be employed, although such diaphragm-type switches are presently preferred for reasons of economy.

The invention claimed is:

1. A system for purging and priming an internal combustion engine which includes a carburetor having an air intake, said system comprising:

pump means including a fuel line coupled through said carburetor to a fuel supply and responsive to an operator for selectively drawing fuel through said carburetor from said supply and thereby purging air from said fuel line and carburetor, means coupled by said fuel line to said pump means and positioned at said air intake for feeding fuel under pressure from said pump means into said air intake, and priming control means including means responsive to pressure of fluid in said fuel line for distinguishing between pumping of air and pumping of fuel by pump means at said intake-positioned means, means coupled to said pressure-responsive means for timing duration of fuel pumping at said intake-positioned means, means for comparing said time duration to a time threshold, and means for indicating completion of a priming operation when said duration exceeds said threshold.

2. The system set forth in claim 1 whereby said pressure-responsive means comprises a pressure switch having electrical contacts which close when pressure in said fuel line exceeds a selected threshold.

3. The system set forth in claim 2 wherein said duration-timing means comprises a timer having a input connected through said pressure switch contacts to a source of electrical power.

4. The system set forth in claim 3 wherein said timer comprises an electronic integrator.

5. The system set forth in claim 4 further comprising means for discharging said integrator over an extended time duration.

6. The system set forth in claim 1 wherein said duration-comparing means comprises temperature sensor means coupled to said engine and responsive to temperature thereof, and means for varying said time threshold as a function of engine temperature.

7. The system set forth in claim 1 wherein said intake-positioned means comprises an orifice for spraying fuel at constant flow into said air intake, such that quantity of fuel sprayed into said air intake is a direct function of said time duration.

8. The system set forth in claim 1 wherein said completion-indicating means comprises light-emitting means.

9. The system set forth in claim 8 wherein said completion-indicating means further comprises an oscillator responsive to said comparing means for driving said light-emitting means.

10. The system set forth in claim 9 wherein said oscillator means has a frequency of less than thirty hertz.

11. The system set forth in claim 1 wherein said pump means comprises a manual pump.

12. A system for purging and priming an internal combustion engine which includes a carburetor having an air intake, said system comprising:

pump means including a fuel pump and a fuel line coupling an inlet of said pump through said carburetor to a fuel supply, said pump being responsive to an operator for drawing fuel from said supply through said carburetor, simultaneously purging air from said carburetor and fuel line, and supplying fuel under pressure at a pump outlet, means including an orifice positioned at said air intake and coupled by said fuel line to said pump outlet for ejecting fuel under pressure at constant flow rate into said air intake, and means for measuring quantity of fuel ejected into said air intake to indicate completion of a priming operation, said quantity-measuring means comprising:

a pressure switch connected to said fuel line between said pump outlet and said orifice and responsive to pressure fluid in said fuel line, an electronic timer responsive to said pressure switch for accumulating duration of time during which fuel is ejected at said constant flow rate into said air intake, and means for comparing accumulated time duration to a time threshold.

13. The system set forth in claim 12 wherein said electronic timer comprises an integration capacitor, and a constant current source coupled to said capacitor and having a control input connected to said pressure switch.

14. The system set forth in claim 13 further comprising means for discharging said capacitor over an extended time duration.

15. The system set forth in claim 14 wherein said completion-indicating means comprises light-emitting means.

16. The system set forth in claim 15 wherein said completion-indicating means further comprises an oscillator responsive to said comparing means for driving said light-emitting means.

17. The system set forth in claim 16 wherein said oscillator means has a frequency of less than thirty hertz.

18. The system set forth in claim 17 wherein said pump means comprises a manual pump.

19. The system set forth in claim 16 wherein said duration-comparing means comprises temperature sensor means coupled to said engine and responsive to temperature thereof, and means for varying said time threshold as a function of engine temperature.

* * * * *